United States Patent [19]

Inoue et al.

[11] 4,415,221

[45] Nov. 15, 1983

[54] FEMALE TYPE ELECTRICAL CONNECTOR

[75] Inventors: Nori Inoue; Shogo Katsuki, both of Yokkaichi, Japan

[73] Assignee: Tokai Electrie Wire Company Limited, Yokkaichi, Japan

[21] Appl. No.: 306,499

[22] Filed: Sep. 28, 1981

[30] Foreign Application Priority Data

Oct. 1, 1980 [JP] Japan ..... 55-140611[U]

[51] Int. Cl.[3] ..... H01R 13/633

[52] U.S. Cl. ..... 339/258 F; 339/74 R

[58] Field of Search ..... 339/74 R, 258 F, 258 S, 339/256 SP

[56] References Cited

U.S. PATENT DOCUMENTS

| | | | |
|---|---|---|---|
| 3,409,867 | 11/1968 | Lessner | 339/258 S |
| 3,796,987 | 3/1974 | Kinkaid et al. | 339/74 R |
| 3,865,457 | 2/1975 | Carter | 339/74 R |
| 3,976,348 | 8/1976 | Simmons | 339/74 R |
| 4,067,633 | 1/1978 | Groft et al. | 339/74 R |
| 4,167,299 | 9/1979 | Noguchi | 339/74 R |
| 4,220,388 | 9/1980 | Dechelette | 339/74 R |

FOREIGN PATENT DOCUMENTS

| | | | |
|---|---|---|---|
| 1159 | 3/1979 | European Pat. Off. | 339/258 S |
| 2853512 | 6/1979 | Fed. Rep. of Germany | 339/74 R |
| 2308216 | 11/1976 | France | 339/258 S |
| 55-11269 | 3/1980 | Japan . | |
| 1463751 | 2/1977 | United Kingdom . | |
| 1539033 | 1/1979 | United Kingdom . | |
| 1531033 | 11/1978 | United Kingdom . | |
| 1597164 | 9/1981 | United Kingdom | 339/74 R |

*Primary Examiner*—John McQuade

*Attorney, Agent, or Firm*—Cushman, Darby & Cushman

[57] ABSTRACT

A female type electrical connector produced by stamping and bending of thin sheet metal including a receptacle section and a wire connection connected to the rear end of the receptacle section. The receptacle section includes a tongue extending from the front end thereof and formed with a locking projection on its upper surface, and being pivotable on its front end for resiliently moving downwardly, and two side walls each having a curved wall. The curved walls of the side walls extend from outside the opposite side edges of the tongue and are curved upwardly to extend above the tongue, and terminating at free ends which extend longitudinally and are juxtaposed to the upper surface of the tongue. The locking projection engages a projection receiving portion of a male electrical connector to lock the latter in place when the male type electrical connector is inserted between the upper surface of the tongue and the free ends of the two side walls and held therebetween. The connector of the female type further includes a pair of lugs projecting from the opposite sides of the tongue for moving the tongue downwardly and extending outwardly through windows formed in the two side walls respectively, and guide walls for supporting the undersurface of the male type electrical connector when the latter is inserted in the receptacle section so that the underside of the male electrical connector may not move the tongue downwardly more than is necessary.

3 Claims, 20 Drawing Figures

FEMALE TYPE ELECTRICAL CONNECTOR

FIELD OF THE INVENTION

This invention relates to electrical connectors used for joining electrical wires or conductors, and more particularly it is concerned with a female type electrical connector adapted to lockingly engage a male type electrical connector projecting outwardly from a functional part of an automotive vehicle, such as a headlamp, horn, oil pressure switch, etc., to provide an electrical connection.

DESCRIPTION OF THE PRIOR ART

FIG. 1 is a view showing a female type electrical connector showing one example of its construction. The female type electrical connector comprises, as shown, a bottom wall or a base plate 50, side walls 51 and 51' rising from opposite sides of the base plate 50 having free ends positioned above the base plate 50, and a tongue 52 bent at the front portion of the base plate 50 through a curved portion to be interposed between the free ends of the side walls 51 and 51' and the base plate 50, to define a receptacle section for holding therein a male type electrical connector or a tab of the opposite member.

The electrical connector of this construction holds the tab between the tongue 52 having a spring action by virtue of the curved portion through which the tongue 52 is bent at the front end portion of the base plate 50 and the free ends of the side walls 51 and 51'. In this construction, when the tab is forcedly inserted in the receptacle section, the curved portion might be bent beyond its limit of elasticity. When this happens, bad connection or unsatisfactory locking might occur in the receptacle section.

The aforesaid forced insertion of the tab tends to occur when the tab is inserted with no directionality as the female type and male type electrical connectors are not regulated by the movements of the female and male housings.

For example, when the female type and male type electrical connectors are used for establishing the connection between a functional part of an automotive vehicle or a headlamp, horn, oil pressure switch, etc., and an external power source, the female type electrical connector contained in the housing and having a receptacle section is connected to the male type electrical connector in the form of a tab projecting from the main body of the functional part and exposed to atmosphere. In some instances, the insertion of the male type electrical connector into the receptacle section of the female type electrical connector may take place at an undesirable angle. In this case, the aforesaid curved portion might be bent beyond its limit of elasticity, resulting in the curved portion causing permanent deformation.

SUMMARY OF THE INVENTION

A first object of this invention is to provide a female type electrical connector capable of advantageously guiding a male type electrical connector as the latter is inserted into the receptacle section of the female type electrical connector, so that no scratching action will occur and deformation of the tongue due to its bending beyond its limit of elasticity can be avoided.

A second object of the invention is to provide a female type electrical connector capable of being preferably brought into and out of locking engagement with a male type electrical connector.

According to the invention, there is provided a female type electrical connector produced by stamping and bending of thin sheel metal comprising a receptacle section and a wire connection connected to the rear end of the receptacle section, the receptacle section comprising a tongue extending from the front end of the receptacle section toward the rear end thereof and formed with a locking projection on its upper surface and being pivotable on its front end to resiliently move downwardly, and two side walls each having a curved wall, the respective curved walls of the side walls extending from outside the opposite side edges of the tongue and curved upwardly to extend above the tongue and terminating at free ends which extend longitudinally and are juxtaposed to the upper surfaces of the tongue, the locking projection being adapted to engage a projection receiving portion of a male type electrical connector to lock the latter in place when the male type electrical connector is inserted between the upper surface of the tongue and the free ends of the two side walls and held therebetween, wherein the improvement comprises:

A pair of lugs projecting from the opposite sides of the tongue for moving the tongue downwardly, the lugs extending outwardly through windows formed in the two side walls respectively; and guide wall means for supporting the undersurface of the male type electrical connector when the latter is inserted in the receptacle section so that the underside of the male electrical connector may not move the tongue downwardly more than is necessary.

Additional and other objects, features and advantages of the invention will become apparent from the description set forth hereinafter when considered in conjunction with the drawings.

DETAILED DESCRIPTION OF THE PREFERRED EMBODIMENTS

Figure 1:
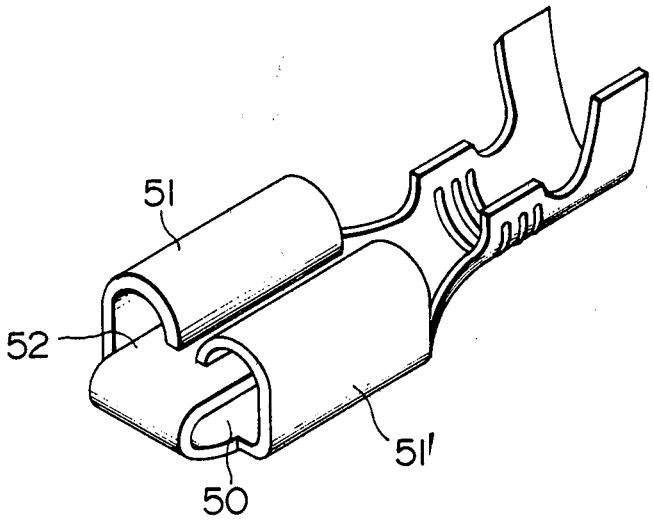
FIG. 1 PRIOR ART
FIG. 1 is a perspective view of a female type electrical connector of the prior art, showing its construction.
Figure 2:
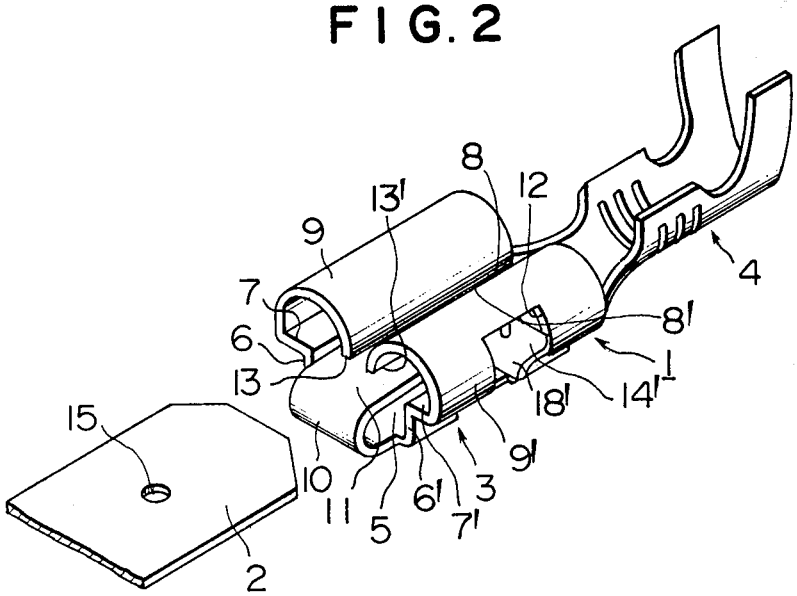
FIG. 2 is a perspective view of the female type electrical connector in accordance with a first embodiment of the invention which is shown as being combined with a tap of the opposite member.
Figure 3:
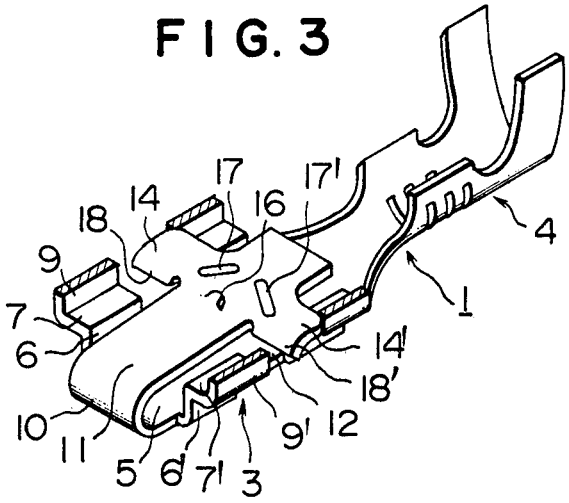
FIG. 3 is a perspective view, with certain parts being cut out, of the female type electrical connector shown in FIG. 2.
Figure 4:
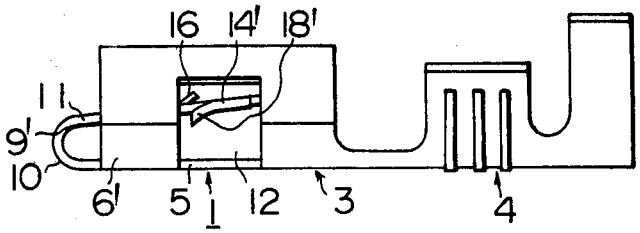
FIG. 4 is a side view of the female type electrical connector shown in FIG. 2.
Figure 5:
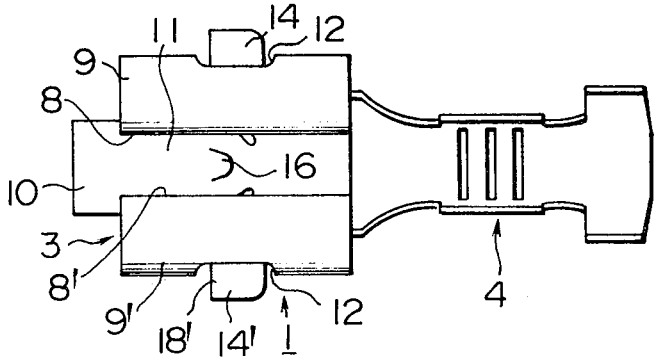
FIG. 5 is a plan view of the female type electrical connector shown in FIG. 2.

FIGS. 2–5 show the female type electrical connector according to a first embodiment of the invention. The electrical connector generally designated by the numeral 1 is produced by stamping and bending of thin sheet metal and comprises a receptacle section 3 for receiving a male type electrical connector or a tab 2 of the opposite member combined with the electrical connector 1, and a wire connection 4 located rearwardly of the receptacle section 3.

The receptacle section 3 comprises first walls 6 and 6′ rising a suitable distance from a bottom wall or a base plate 5 on opposite sides thereof, second walls 7 and 7′ extending outwardly from the upper ends of the first walls 6 and 6′ by a suitable distance, curved walls or third walls 9 and 9′ rising from the side edges of the second walls 7 and 7′ by a suitable distance and bent until free end portions 8 and 8′ are located above the base plate 5, and a tongue 11 bent at the forward end portion of the base plate 5 through a curved portion 10 so that the tongue 11 is interposed between the base plate 5 and the curved third walls 9 and 9′.

The receptacle section 3 has windows 12 each formed in one of the side walls on opposite sides of the base plate 5.

The free end portions 8 and 8′ of the third walls 9 and 9′ are curved inwardly and have free edges 13 and 13′ respectively juxtaposed against the base plate 5 and extending longitudinally.

The tongue 11 is formed with lugs 14 and 14′ on opposite sides which extend outwardly of the receptacle section 3 through the windows 12, and a projection 16 in the central portion which is formed by forming cutting line in the tongue 11 and upwardly bending the cut portion from the direction of the free end of the tongue 11.

The numerals 17 and 17′ designate ribs extending from the body of the tongue 11 to the lugs 14 and 14′ to reinforce the lugs 14 and 14′.

The lugs 14 and 14′ include downwardly curved portions 18 and 18′ respectively located in the forward side edges of the lugs 14, 14′.

The wire connection 4 is continuous rearwardly of the base plate 5 of the receptacle section 3 and the first walls 6 and 6′ rising a suitable distance on the opposite sides of the base plate 5.

Figure 9:
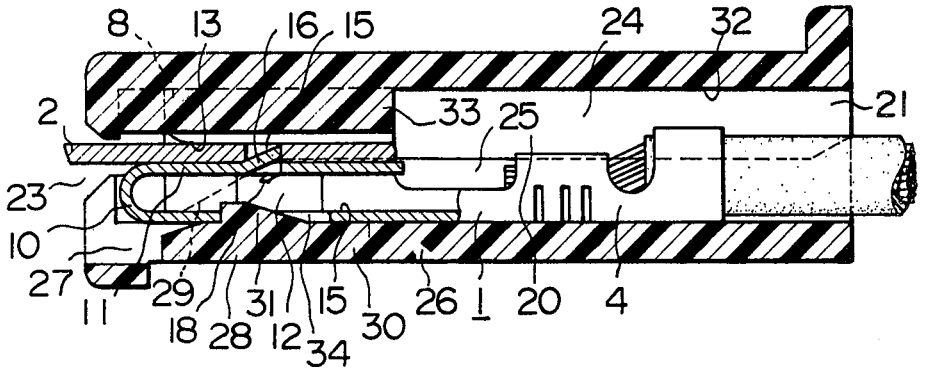
FIGS. 9 and 10 show the female type electrical connector of the first embodiment arranged in the housing when in service.
Figure 10:
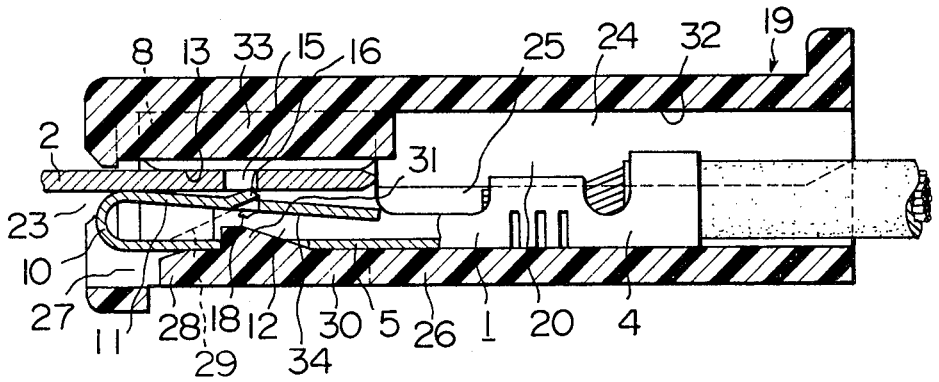

As shown in FIGS. 9 and 10, the base plate 5 is formed with an opening 34.

Figure 6:
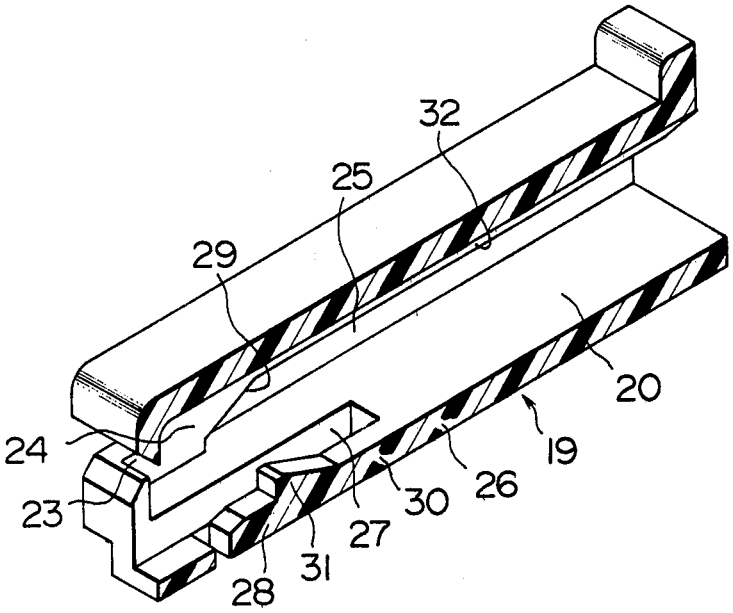
FIG. 6 is a perspective view, with certain parts being cut out, of a housing for the female type electrical connector of the first embodiment.
Figure 7:
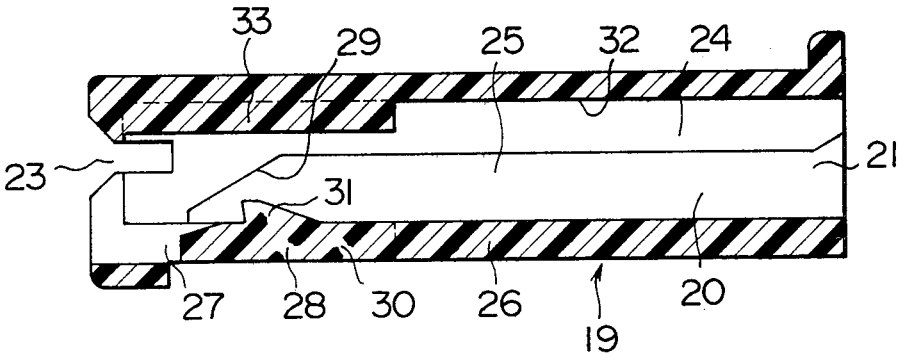
FIG. 7 is a vertical sectional view of the housing shown in FIG. 6.
Figure 8:
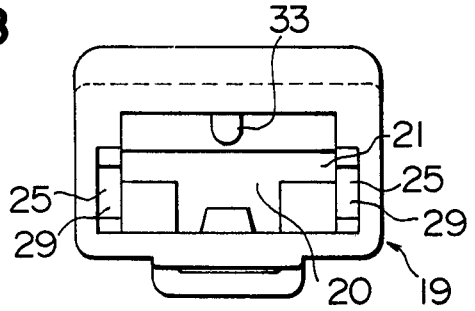
FIG. 8 is a right side view of the housing shown in FIG. 6.

Referring to FIGS. 6–8, there is shown a housing 19 for the female type electrical connector of the aforesaid construction. The housing 19 is formed with an inserting opening 21 at its rear end portion for inserting the female type electrical connector 1 therethrough into the housing 19, a socket 23 for receiving therein the tap 2 at its front end portion which is the contacting portion of the male type electrical connector, guide grooves 25 formed at opposite side surfaces 24 respectively for pressing the lugs 14 and 14′ downwardly by the relative movements of the housing 19 and the female type electrical connector 1, and a lance 28 in the forward portion of a bottom wall 26 having a free end formed by a cutout 27.

The guide grooves 25 each have a bottom surface which is flush with the upper surface of the bottom wall 26, and the upper surface of each guide groove 25 is parallel with the bottom surface from the rear portion to the central portion and is gradually tapered at the front portion toward the bottom surface to have an inclined surface 29.

The lance 28 comprises an elastic arm 30 projecting from the cut end of the bottom wall 26 and arranged on the same line as the bottom wall 26 toward the cutout 27 formed in the front portion of the bottom wall 26, and a projection 31 in the upper portion of the arm 30 having an inclined surface in the rear portion and a vertical surface in the front portion.

Meanwhile a rib 33 extending axially of the housing 19 is formed in the center of the front portion of the inner surface of an upper wall 32 of the housing 19.

The socket 23 has different widths for upper and lower portions thereof. That is, the width of the upper portion corresponds to that of the tab 2 received therein, and the width of the lower portion corresponds to those of the base plate 5 and the tongue 11.

Insertion of the female type electrical connector 1 in the housing 19 of the aforesaid construction is effected in such a manner that when the insertion is carried out, the lugs 14 and 14′ are guided by the guide grooves 25 as shown in FIG. 9, the rib 33 is interposed between the free ends 8 and 8′ of the third walls 9 and 9′, and the opening 34 of the base plate 5 receives in engagement the projection 31 of the lance 28 with a certain play in the axial direction.

Figure 11:
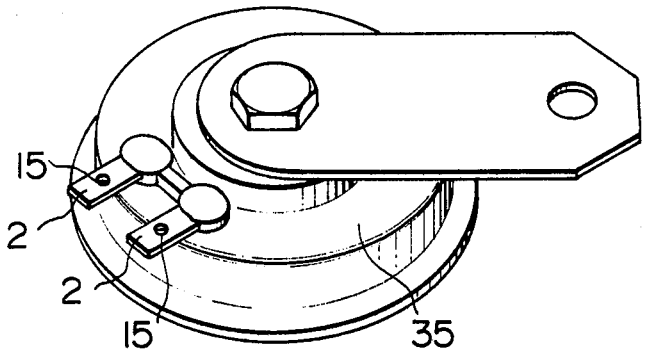
FIG. 11 is a perspective view of a horn.

FIG. 11 shows a horn 35 which projects outwardly while exposing the tabs 2 constituting the electrical contact of a male type electrical connector. The tabs 2 are each formed with the opening 15 or a recess formed on the underside which serve as the engaging portion for the projection 16 formed on the tongue 11.

The female type electrical connector 1 inserted in the housing 19 holds one of the tabs 2 between the second walls 7 and 7′ and the free edges 13 and 13′ of the third side walls 9 and 9′, and has the projection 16 formed on the tongue 11 engaged in the opening 15 formed in each tab 2, to bring them into locking engagement with each other (See FIG. 9).

Locking engagement of the tab 2 with the female type electrical connector 1 is effected by inserting the tab 2 between the tongue 11 of the female type electrical connector 1 and the free ends or edges 13 and 13′ of the third walls 9 and 9′. The insertion can take place in good condition as the tab 2 is guided between the second walls 7 and 7′ and the free edges 13 and 13′ of the third walls 9 and 9′. Particularly the construction in which the undersurface of the tab 2 is guided by the second walls 7 and 7′ is advantageous in that it enables the tab 2 to be inserted in the socket 33 without damaging the resilience of the tongue 11. More specifically, if the tab 2 strongly forces the tongue 11 against the base plate 5, the tongue 11 will be deformed beyond its limit of elasticity, with the result that the resilience of the tongue 11 imparted by the curved portion 10 would be unduly reduced. Thus, the second walls 7 and 7' serve as guide wall means for guiding the undersurface of the tab 2 in good condition.

The female type electrical connector 1 and the male type electrical connector 2 brought into locking engagement as described hereinabove can be brought out of locking engagement by moving downwardly the lugs 14 and 14' projecting from the opposite sides of the tongue 11. The lugs 14 and 14' can be moved downwardly by moving the housing in a direction in which it is moved away from the tab 2, as shown in FIG. 10.

More specifically, as the housing 19 is moved in a direction in which it is moved away from the tab 2 within the range of play of the projection 31 in the opening 34, the inclined surfaces 29 formed in the front portions of the upper walls of the guide grooves 25 move while being maintained in contact with the curved portions 18 and 18' of the lugs 14 and 14' respectively, to thereby push the lugs 14 and 14' downwardly and release the projection 16 of the tongue 11 from engagement in the opening 15 of the tab 2. Thus the female and male type electrical connectors are released from locking engagement with each other.

As can be clearly seen, when the lugs 14 and 14' are being pressed downwardly, the tongue 11 is resiliently moved downwardly in pivotal movement with the curved portion 10 serving as the pivot. Thus it will be seen that where the distance between the lugs 14 and 14' and the curved portion 10 serving as the pivot is reduced relative to what length would be required if the lugs 14, 14' were located beyond the end of walls 9, it is possible to move the projection 16 downwardly a necessary amount out of engagement in the opening 15 by slightly depressing the lugs 14 and 14'. Stated differently, by reducing the distance between the lugs 14 and 14' and the curved portion 10, it is possible to release the projection 16 from engagement in the opening 15 by moving the housing 19 a small distance in a direction in which it is moved away from the tab 2, to thereby bring the female and male type electrical connectors out of locking engagement with each other. This makes it possible to reduce the longitudinal dimension of the housing 19. The end of reducing the distance between the curved portion 10 and the lugs 14 and 14' is attained in the embodiment shown and described hereinabove by causing the lugs 14 and 14' to project through the windows 12 formed in the longitudinal central portion of the two side walls of the receptacle section 3. If no windows 12 were provided and the lugs 14 and 14' projects sideways from the position between the rear end of the receptacle section 3 and the wire connection 4, the distance between the curved portion 10 and the lugs 14 and 14' would become too large.

From the foregoing description, it will be appreciated that the female type electrical connector according to the first embodiment of the invention can be brought positively into locking engagement with the tab 2 of a headlamp, horn, oil pressure switch, etc., of an automotive vehicle that is exposed to the outside, so that it is difficultly released from engagement with the tab even if subjected to vibration. Although the female type electrical connector is not readily dislodged while in service, it is possible to manually release the same from locking engagement with the tab if it is desired to do so, and it is possible to maintain electrical contact in stable condition in the connection thus formed between the female type electrical connector and the tab. The female type electrical connector 1 shown and described as the first embodiment of the invention is provided with means for guiding the connector 1 in good condition in the receptacle portion 3 without damaging the resilience of the tongue 11 in bringing the tab 2 into and out of locking engagement with the female type electrical connector 1. Moreover, the female type electrical connector 1 of the first embodiment offers the advantage that the longitudinal dimension of the housing 19 coacting therewith can be reduced.

FIGS. 12–15 show the female type electrical connector 101 according to a second embodiment. The differences between the second embodiment and the first embodiment are as stated hereinafter. In the first embodiment, the tongue 11 is bent at the forward end of the bottom wall or the base plate 5. As can be clearly seen in FIG. 15, the tongue 111 of the second embodiment is cut-and-raised from the base plate. The construction of the second embodiment enables the area of the material to be greatly reduced when the receptacle section 103 is formed by stamping with a die, thereby making it possible to economize the material.

In the second embodiment, the two side walls 109 and 109' connected in one piece to the electrical connection 104 of the same construction as the first embodiment are connected to a front wall 141 in the forward portion through a widthwide depression 140 from which the tongue 111 extends. More specifically, the tongue 111 is cut by forming slits 142 and 142' from a sheet metal material portion corresponding to the base plate 5 of the first embodiment, so that the tongue 111 is connected to the sheet metal material at the widthwide depression 140. Formed in the tongue 111 in the vicinity of its longitudinal central portion are lugs 114 and 114' projecting sideways in opposite directions which extend outwardly through windows 112 formed in the opposite side walls 109 and 109' respectively.

The front wall 141 is shaped such that it is curved downwardly from the position of the widthwide depression 140. The opposite side walls 109 and 109' are in the form of curved walls which extend to a position above the tongue 111 after extending below the tongue 111 from a position adjacent the opposite side edges of the tongue 111. The side walls 109 and 109' have free ends or edges 113 and 113' which are juxtaposed against the upper surface of the tongue 111.

Figure 12:
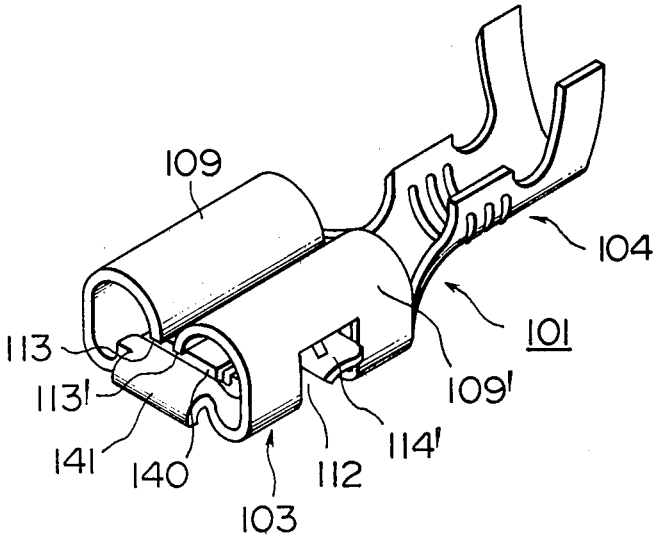
FIG. 12 is a perspective view of the female type electrical connector according to a second embodiment of the invention.
Figure 13:
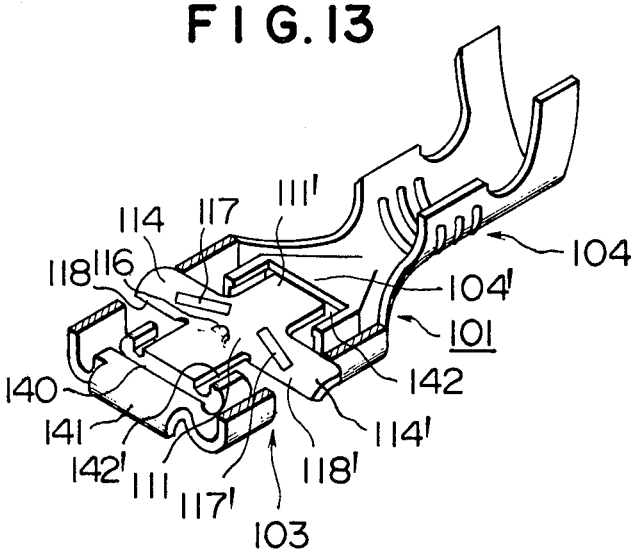
FIG. 13 is a perspective view, with certain parts being cut out, of the female type electrical connector shown in FIG. 12.
Figure 14:
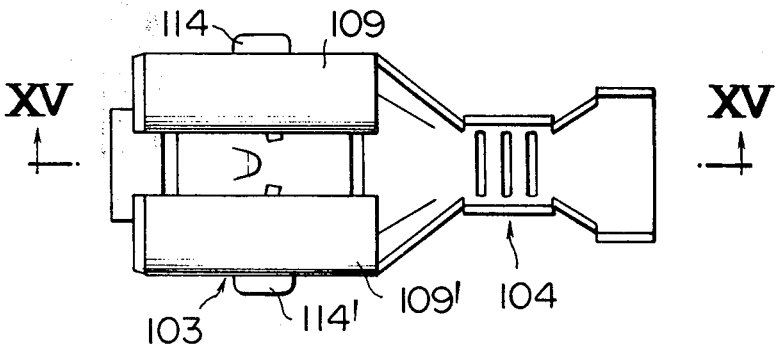
FIG. 14 is a plan view of the female type electrical connector of the second embodiment.
Figure 15:
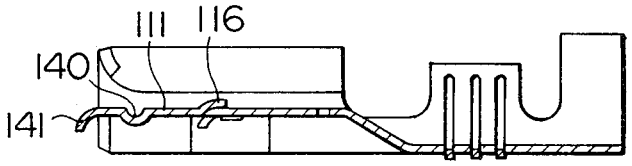
FIG. 15 is a sectional view taken along the line XV–XV in FIG. 14.

As can be seen in FIG. 13, a rear end portion 111' of the tongue 111 and the wall portion of a front end portion 104' of the wire connection 104 are separated from each other by the slits 142 and 142'. As can be seen in FIG. 12, the front end of the receptacle portion 103 and the wire connection 104 are connected through the opposite side walls 109 and 109'. Thus when the lugs 114 and 114' are moved downwardly, the tongue 111 moves downwardly in pivotal movement with the widthwide depression 140 serving as the pivot in such a manner that its rear end portion 111' moves downwardly. When the force depressing the lugs 114 and 114' is removed, the tongue 111 having been moved downwardly in pivotal movement is resiliently restored to its original position. The tongue 111 is formed with a projection 116 and ribs 117 and 117' similar to the projection 16 and ribs 17 and 17' of the first embodiment.

Like the lugs 14 and 14' of the first embodiment, the lugs 114 and 114' are formed with curved portions 118 and 118' respectively which are formed on the front edges of the lugs 14 and 14' and downwardly curved.

Figure 16:
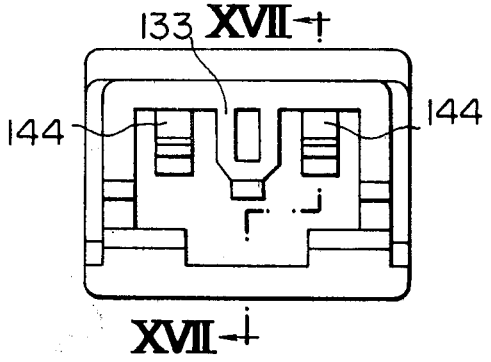
FIG. 16 is a view of a housing for the electrical connector of the second embodiment as seen from the front or the left side view of FIG. 17.
Figure 17:
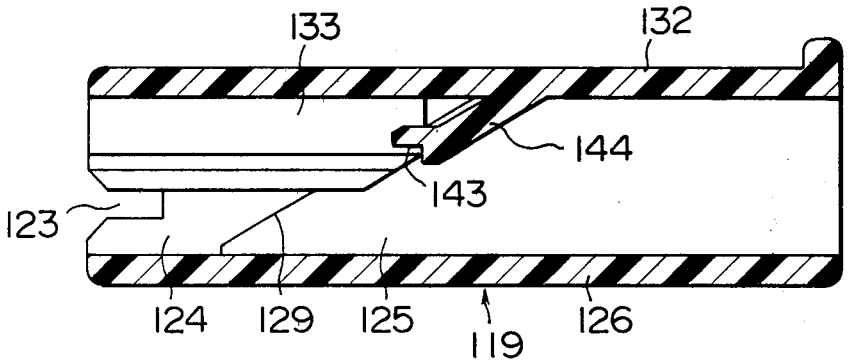
FIG. 17 is a sectional view taken along the line XVII–XVII in FIG. 16.
Figure 18:
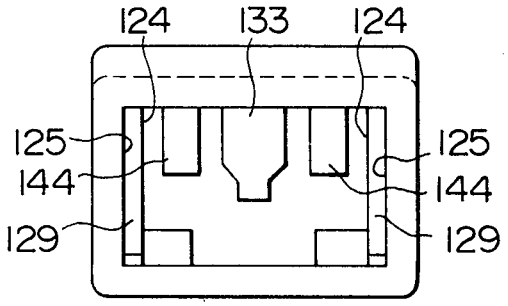
FIG. 18 is a right side view of FIG. 17.

FIGS. 16–18 show a housing 119 for the female type electrical connector 101 of the second embodiment according to the invention. As shown, the housing 119 is formed at its front end with a socket 123 for receiving the tab 2 which is the contact portion of a male type electrical connector and on opposite side surfaces 124 with guide grooves or recesses 125 for depressing the lugs 114 and 114' respectively by the relative movements of the housing 119 and the female type electrical connector 101.

As shown in FIG. 17, the guide groove 125 includes an inclined surface 129 disposed at its left edge and tilting from the bottom wall 126 toward the upper wall 132 rightwardly in the figure. A rib 133 extending longitudinally of the housing 119 is formed in the central position of the front portion of the upper wall 132 of the housing 119, and the upper wall 132 has on its inner surface a pair of lances 144 provided with cutouts 143 each engaging the rear end of one of the opposite side walls 109 and 109' of the electrical connector 101.

Figure 19:
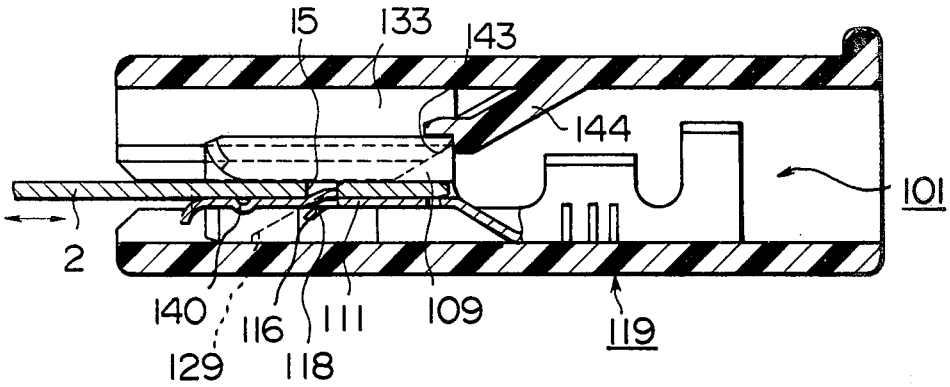
FIGS. 19 and 20 show the female type electrical connector of the second embodiment arranged in the housing when in service.

The female type electrical connector 101 is inserted in the housing 119 in such a manner that the lugs 114 and 114' are positioned in the respective guide grooves 125, the rib 133 is interposed between the opposite side walls 109 and 109' and the rear ends of the opposite side walls 109 and 109' engage the respective cutouts 143 of the lances 144, as shown in FIG. 19. By inserting the tab 2 which is the contact portion of a male type electrical connector between the tongue 111 and the free ends 113 and 113' of the opposite side walls 109 and 109' while the female type electrical connector 101 is placed in the housing 119 as aforesaid, the tab 2 is guided in good condition by the tongue 111 and the free ends 113 and 113' in its movement to the receptacle section 103 to be mounted therein. With the projection 116 on the tongue 111 engaged in the opening 15 formed in the tab 2, the tab 2 is positively placed in locking engagement in the receptacle portion 103.

Particularly, in the second embodiment, the tongue 111 moves resiliently in pivotal movement with the widthwide depression 140 serving as the pivot, and when the tab 2 is inserted into the connector 101 the undersurface of the tab 2 is guided by a portion of the tongue 111 which has relatively high rigidity or the upper surface of the front wall 141 positioned anterior to the widthwide depression 140 and the upper surfaces of portions of the opposite side walls 109 and 109' adjacent the opposite side edges of the tongue 111 and the widthwide depression 140, so that the tab 2 can be held substantially parallel to the tongue 111. Thus it is possible to avoid a reduction in the resilience of the tongue 111 that might occur when the tongue 111 is deformed beyond its limit of elasticity as the tab 2 depresses the tongue 111 more than is necessary.

Figure 20:
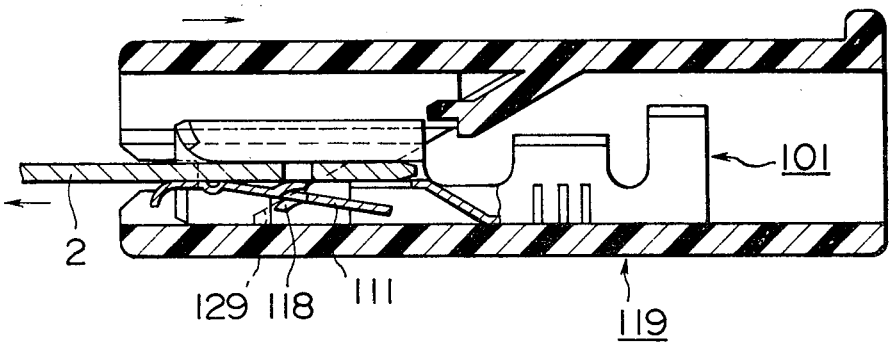

The two electrical connectors brought to locking engagement with each other as described hereinabove are released from locking engagement by pressing downwardly the lugs 114 and 114' projecting from the opposite sides of the tongue 111. The lugs 114 and 114' are pressed downwardly as the housing 119 is moved in a direction in which it is moved away from the tab 2, as shown in FIG. 20.

More specifically, as the housing 119 is moved in a direction in which it is moved away from the tab 2, the end edges of the guide grooves 125 move while the curved portions 118 and 118' of the lugs 114 and 114' are kept in contact with the inclined surfaces 129 of the grooves 125 respectively, to thereby release the projection 116 of the tongue 111 from engagement in the opening 15 of the tab 2 to bring the female and male type electrical connectors out of locking engagement with each other.

The lugs 114 and 114' of the second embodiment project sideways through the windows 112 formed in the vicinity of the central portions of the opposite side walls 109 and 109' as viewed longitudinally, like the lugs 14 and 14' of the first embodiment. This reduces the distance between the widthwide depression 140 which is the pivot for the pivotal movement of the tongue 111 and the lugs 114 and 114', thereby offering the advantage that the longitudinal dimension of the housing 119 can be reduced.

The female type electrical connector 101 of the second embodiment is more advantageous than that of the first embodiment in that the material is lower in consumption. As described hereinabove, the connectors of the first and second embodiments are produced by stamping and bending of thin sheet metal. The first embodiment is less advantageous in that since the tongue 11 has a large longitudinal dimension and a small crosswise dimension, the material disposed on opposite sides of the tongue 11 in a blank in which the tongue 11 is not yet bent in the curved portion 10 is wasted when such blank is obtained from the thin sheet metal. The second embodiment is free from such disadvantage.

From the foregoing description, it will be appreciated that the female type electrical connector according to the invention enables a male type electrical connector to be readily and positively brought into and out of locking engagement therewith. The added advantages offered by the invention are that substantial reduction does not occur in the resiliency of the tongue no matter how many times the male and female type connectors are brought into and out of locking engagement, and that the housing for the female type electrical connector can be reduced in longitudinal dimension.

What is claimed is:

1. A female type electrical connector produced by stamping and bending of thin sheet metal comprising a receptacle section and a wire connection connected to the rear end of said receptacle section, said receptacle section comprising a tongue extending from the front end of said receptacle section toward the rear end thereof and formed with a locking projection on its upper surface and being pivotable on its front end to resiliently move downwardly, and two side walls each having a curved wall, the respective curved walls of said side walls extending from outside the opposite side edges of the tongue and curved upwardly to extend above the tongue and terminating at free ends which extend longitudinally and are juxtaposed to the upper surface of the tongue, said locking projection being adapted to engage a projection receiving portion of a male type electrical connector to lock the latter in place when the male type electrical connector is inserted between the upper surface of the tongue and the free ends of the two side walls and held therebetween, wherein the improvement comprises:

a pair of lugs projecting from the opposite sides of the tongue for moving the tongue downwardly, said lugs extending outwardly through windows formed in the two side walls respectively; and guide wall means for supporting the undersurface of the male type electrical connector when the latter is inserted in the receptacle section so that the underside of the male electrical connector may not move the tongue downwardly more than is necessary.

2. A female type electrical connector as claimed in claim 1, wherein each of said two side walls comprises a first wall rising from the side edge portion of a bottom wall of the receptacle section, and a second wall extending laterally outwardly and substantially horizontally from the upper edge of the first wall and constituting said guide wall means, one of said curved walls extending from the side edge of each second wall, and wherein said tongue is in the form of a strip bent rearwardly through a curved portion at the front end of said bottom wall and extending longitudinally above the bottom wall.

3. A female type electrical connector as claimed in claim 1, wherein said receptacle section comprises a bottom wall connected at its front end portion to said wire connection through said two side walls and separated at its rear end portion from wall portion of the wire connection, said bottom wall constituting said tongue which is capable of resiliently moving downwardly as it is depressed with the front end portion serving as a pivot, the vicinity of the front end portion of the bottom wall constituting said guide wall means.

* * * * *

UNITED STATES PATENT AND TRADEMARK OFFICE

CERTIFICATE OF CORRECTION

PATENT NO. : 4,415,221

DATED : November 15, 1983

INVENTOR(S) : Nori INOUE and Shogo KATSUKI

It is certified that error appears in the above-identified patent and that said Letters Patent is hereby corrected as shown below:

On the title page re Assignee [Item 73]

change "Tokai Electrie Wire Company Limited" to

-- Tokai Electric Wire Company Limited --

Signed and Sealed this

*Eighth* Day of *January 1985*

[SEAL]

*Attest:*

*Attesting Officer*

GERALD J. MOSSINGHOFF

*Commissioner of Patents and Trademarks*